US008484860B2

(12) United States Patent
Moon et al.

(10) Patent No.: US 8,484,860 B2
(45) Date of Patent: Jul. 16, 2013

(54) CLOTHES TREATING APPARATUS

(75) Inventors: Jung Wook Moon, Changwon-si (KR); Dae Yun Park, Changwon-si (KR); Sog Kie Hong, Changwon-si (KR); Jong Seok Kim, Changwon-si (KR); Seung Gyu Ryu, Changwon-si (KR); Hye Yong Park, Changwon-si (KR); Chang Gyu Choi, Changwon-si (KR); Dong Won Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 683 days.

(21) Appl. No.: 12/733,027

(22) PCT Filed: Aug. 1, 2008

(86) PCT No.: PCT/KR2008/004479

§ 371 (c)(1),
(2), (4) Date: Feb. 3, 2010

(87) PCT Pub. No.: WO2009/020305

PCT Pub. Date: Feb. 12, 2009

(65) Prior Publication Data

US 2010/0132208 A1 Jun. 3, 2010

(30) Foreign Application Priority Data

Aug. 3, 2007 (KR) ..... 10-2007-0078141

(51) Int. Cl.
*F22B 25/00* (2006.01)

(52) U.S. Cl.
USPC ..... 34/90; 34/104; 34/202; 34/210; 68/5 C; 223/14; 223/70; 38/7; 38/14; 8/158

(58) Field of Classification Search
USPC ..... 34/90, 104, 201, 202, 595, 601, 210, 34/218; 68/5 C, 18 R; 223/14, 70; 38/2, 7, 38/14; 8/137, 158
See application file for complete search history.

(56) References Cited

U.S. PATENT DOCUMENTS

| | | | | | |
|---|---|---|---|---|---|
| 3,748,746 | A | * | 7/1973 | Robandt | 34/82 |
| 4,471,537 | A | * | 9/1984 | Meda | 34/77 |
| 4,908,957 | A | * | 3/1990 | Acosta et al. | 34/86 |
| 5,369,892 | A | * | 12/1994 | Dhaemers | 34/275 |
| 5,546,678 | A | * | 8/1996 | Dhaemers | 34/275 |
| 5,555,640 | A | * | 9/1996 | Ou | 34/202 |
| 5,701,684 | A | * | 12/1997 | Johnson | 34/595 |

(Continued)

FOREIGN PATENT DOCUMENTS

| | | | |
|---|---|---|---|
| DE | 3943082 | A1 * | 7/1991 |
| EP | 627519 | A1 * | 12/1994 |

(Continued)

*Primary Examiner* — Steve M Gravini
(74) *Attorney, Agent, or Firm* — McKenna Long & Aldridge LLP

(57) ABSTRACT

Disclosed is a clothes treating apparatus, which treats clothes into a more wearable condition. A clothes treating apparatus includes a cabinet; an accommodating space defined in the cabinet to accommodate clothes, and maintained in a stationary state; an air supplying device generating dry air and supplying the dry air into the accommodating space such that the dry air is circulated in the accommodating space, wherein the air supplying device includes an inlet provided at a bottom of the accommodating space such that the air in the accommodating space flows into the air supplying device through the inlet; and a filter assembly installed in the inlet, and filtering the air passing through the inlet.

15 Claims, 7 Drawing Sheets

U.S. PATENT DOCUMENTS

| | | | | |
|---|---|---|---|---|
| 5,755,040 | A * | 5/1998 | Ou | 34/202 |
| 6,134,806 | A * | 10/2000 | Dhaemers | 34/404 |
| 6,726,186 | B2 * | 4/2004 | Gaaloul et al. | 261/81 |
| 6,792,695 | B2 * | 9/2004 | Fry et al. | 34/597 |
| 7,191,546 | B2 * | 3/2007 | Maruca | 34/201 |
| 7,908,766 | B2 * | 3/2011 | Ahn et al. | 34/595 |
| 8,006,336 | B1 * | 8/2011 | Gerlach et al. | 8/158 |
| 8,087,184 | B2 * | 1/2012 | Banta et al. | 34/602 |
| 2005/0076535 | A1 * | 4/2005 | Guinibert et al. | 34/601 |
| 2006/0179676 | A1 * | 8/2006 | Goldberg et al. | 34/77 |
| 2010/0154248 | A1 * | 6/2010 | Stolze | 34/493 |
| 2011/0174022 | A1 * | 7/2011 | Ryu et al. | 68/5 C |
| 2012/0017654 | A1 * | 1/2012 | Park et al. | 68/5 C |
| 2012/0060387 | A1 * | 3/2012 | Wang | 34/86 |
| 2012/0144687 | A1 * | 6/2012 | Yeom | 34/82 |

FOREIGN PATENT DOCUMENTS

| | | | |
|---|---|---|---|
| EP | 1 205 592 | | 5/2002 |
| EP | 1793030 | A2 * | 6/2007 |
| WO | WO 9508016 | A1 * | 3/1995 |

* cited by examiner

CLOTHES TREATING APPARATUS

This application is a National Stage Entry of International Application No. PCT/KR2008/004479, filed on Aug. 1, 2008, and claims priority to Korean Patent Application 10-2007-0078141, filed Aug. 3, 2007, each of which are hereby incorporated by reference in their entireties as if fully set forth herein.

TECHNICAL FIELD

The present invention relates to an apparatus, which treats clothes into a more wearable state, and more particularly, to a structure, which circulates air in an apparatus.

BACKGROUND ART

Generally, a clothes treating apparatus is an apparatus, which treats clothes into a more wearable state. The clothes treating apparatus fundamentally dries clothes and removes wrinkles, odors, bacteria, and static electricity from the clothes.

In order to perform the above functions, it is necessary to circulate air in a space, accommodating clothes. Further, in order to effectively treat the clothes, it is important to optimize the air circulation.

In case that the clothes treating apparatus treats clothes containing odors or dust, the odors or dust may be transferred to other clothes by the air circulation. Particularly, the dust or nap may be supplied to parts of the clothes treating apparatus by the air circulation, and thus cause some trouble in the parts.

DISCLOSURE OF INVENTION

Technical Problem

The present invention has been made in view of the above-mentioned problem, and an object of the present invention is to provide a clothes treating apparatus, which optimizes air circulation therein.

Another object of the present invention is to provide a clothes treating apparatus, which effectively removes dust or odors from circulated air.

Technical Solution

To achieve the objects as mentioned above, the present invention provides a clothes treating apparatus comprising: a cabinet; an accommodating space defined in the cabinet to accommodate clothes, and maintained in a stationary state; an air supplying device generating dry air and supplying the dry air into the accommodating space such that the dry air is circulated in the accommodating space, wherein the air supplying device includes an inlet provided at a bottom of the accommodating space such that the air in the accommodating space flows into the air supplying device through the inlet; and a filter assembly installed in the inlet, and filtering the air passing through the inlet.

The inlet and the filter assembly may be provided at a front portion of the bottom of the accommodating space, and further be provided at a front edge of the bottom of the accommodating space. The clothes treating apparatus may further include a door installed at the cabinet to open and close an entrance formed at a front portion of the accommodating space, and the inlet and the filter assembly may be disposed adjacent to the door.

The inlet and the filter assembly may be provided at a rear portion of the bottom of the accommodating space.

The filter assembly may be detachably installed in the inlet, and include filter and a case to accommodate the filter.

The filter assembly may include at least one of an antibiotic filter, a deodorant filter, and an aromatic filter, or include all of the antibiotic filter, the deodorant filter, and the aromatic filter.

The antibiotic filter, the deodorant filter, and the aromatic filter may be sequentially disposed in the flow direction of the dry air. Further, the antibiotic filter may be disposed adjacent to an inlet part of the filter assembly, the aromatic filter may be disposed adjacent to an outlet part of the filter assembly, and the deodorant filter may be disposed between the antibiotic filter and the aromatic filter.

The air supplying device may further include cutlets provided in the bottom of the accommodating space or in the rear surface of the accommodating space such that the generated dry air is discharged to the inside of the accommodating space through the cutlets.

The clothes treating apparatus may further include a moisture supplying device supplying moisture into the accommodating space.

Advantageous Effects

The above-described clothes treating apparatus effectively refreshes clothes due to the flow of hot and dry air, which is uniformly diffused and distributed. Further, the clothes treating apparatus effectively removes foreign substances and filth or dirt of the clothes and odors from the flow of the air.

BRIEF DESCRIPTION OF THE DRAWINGS

The accompanying drawings, which are included to provide a further understanding of the invention, illustrate embodiments of the invention and together with the description serve to explain the principle of the invention.

In the drawings.

BEST MODE FOR CARRYING OUT THE INVENTION

Now, a clothes treating apparatus in accordance with one embodiment of the present invention will be described in detail with reference to the annexed drawings.

Figure 1:
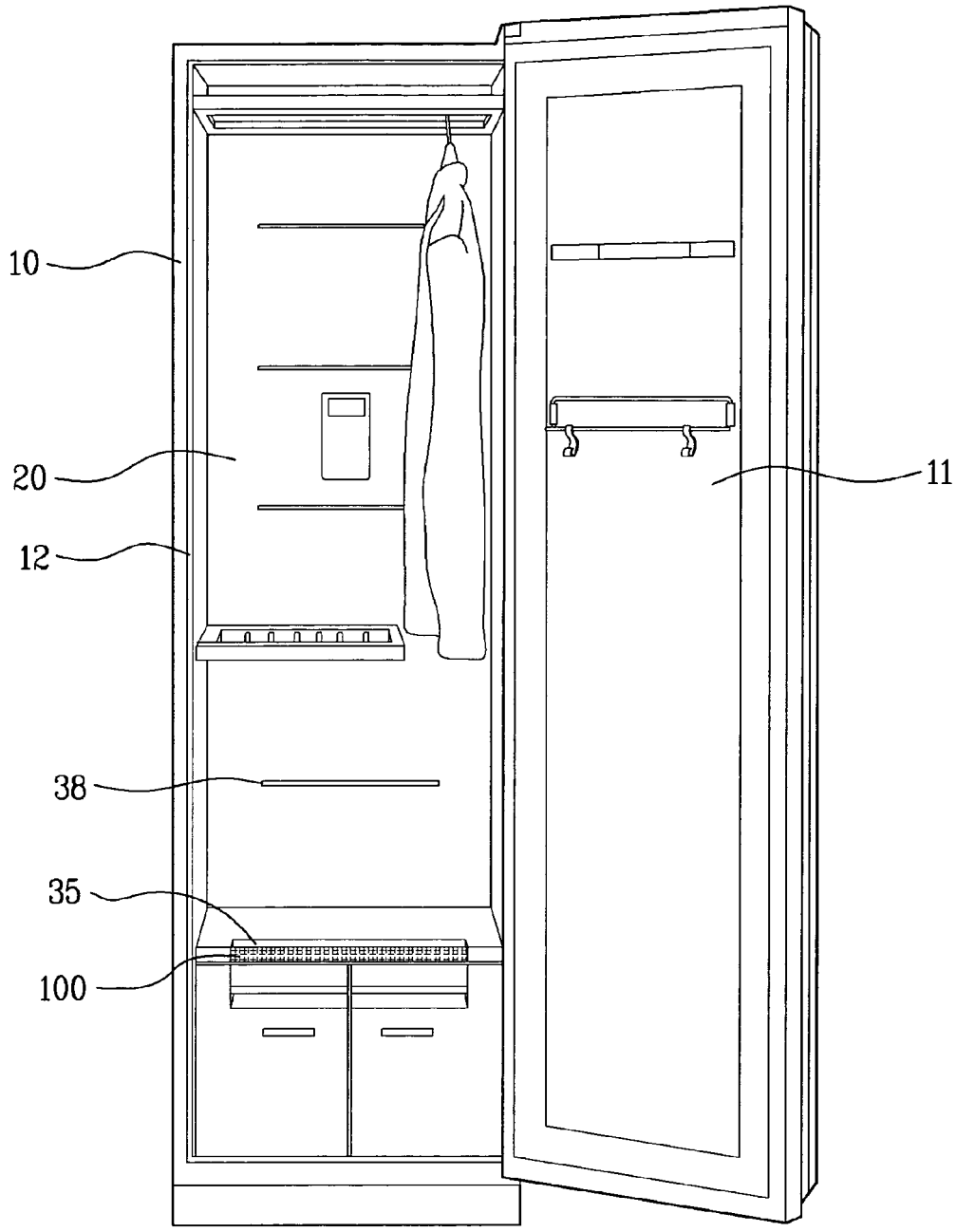
FIG. 1 is a front view illustrating a clothes treating apparatus in accordance with the present invention.
Figure 2:
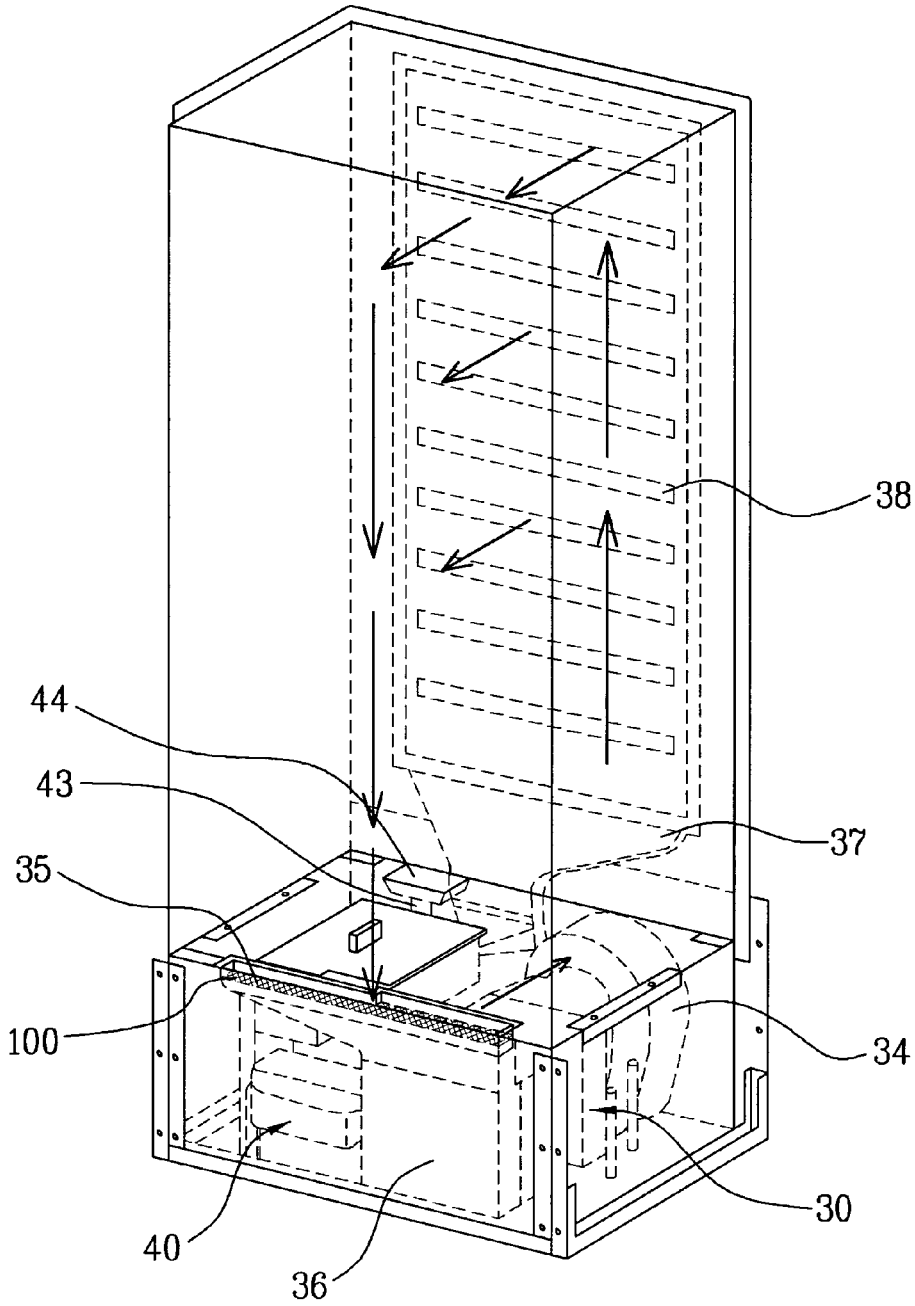
FIG. 2 is a perspective view illustrating a configuration of the clothes treating apparatus.
Figure 3:
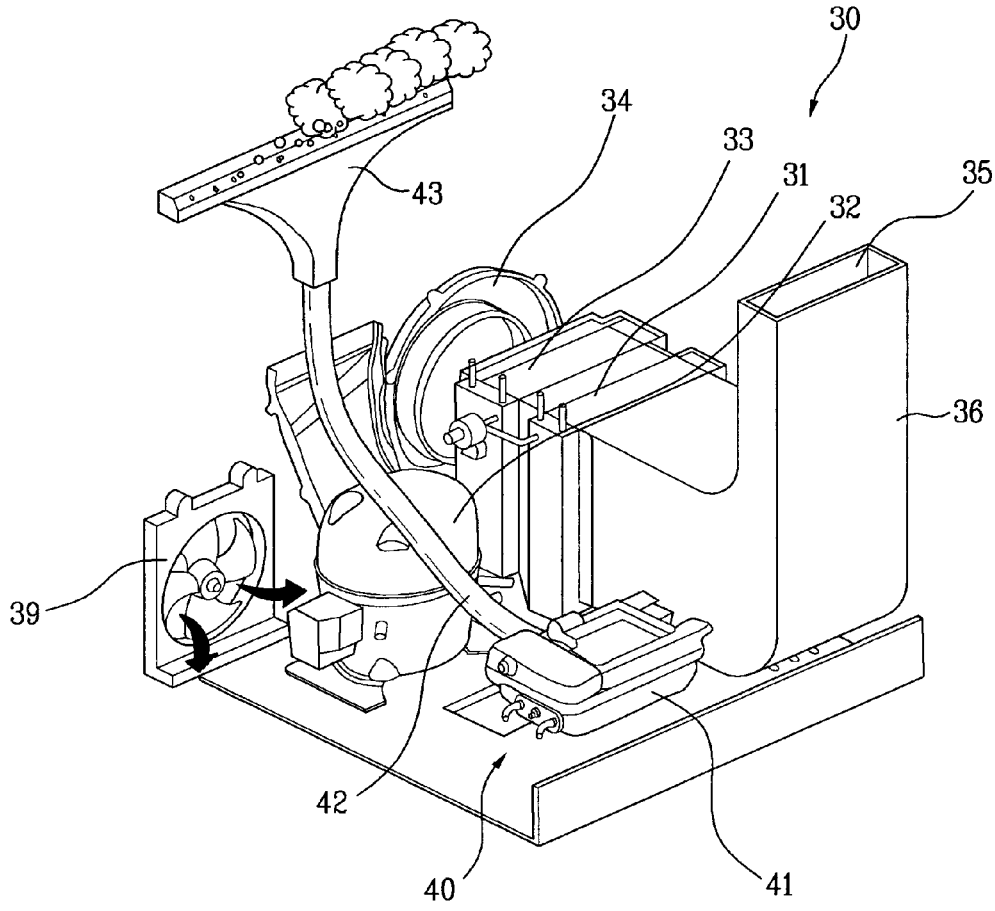
FIG. 3 is a perspective view illustrating a configuration of air and moisture supplying devices.

FIG. 1 is a front view illustrating a clothes treating apparatus in accordance with the present invention, FIG. 2 is a perspective view illustrating the internal configuration of the clothes treating apparatus, and FIG. 3 is a perspective view illustrating the configuration of air and moisture supplying devices.

First, a cabinet 10 forms the external appearance of the clothes treating apparatus of the present invention, and an accommodating space 20, which accommodates clothes to be treated, is formed in the cabinet 10. As shown in FIG. 1, the accommodating space 20 is formed in an inner cabinet 12 separately provided in the cabinet 10, actually. The inner cabinet 12 is fixed to the cabinet 10, and thus remains stationary. Like the inner cabinet 12, the accommodating space 20 does not move. The accommodating space 20 and the inner cabinet 12 are disposed in the upper portion of the cabinet 10, and the front surface portion of the accommodating space 20 is opened. That is, the accommodating space 20 has an entrance formed at the front surface portion thereof, and a user easily puts clothes into the accommodating space 20 through the entrance. The accommodating space 20 is selectively opened and closed by a door 11 rotatably installed at the cabinet 10. Further, various switches (not shown) to operate the clothes treating apparatus are provided on the external surface of the door 11 or the cabinet 10.

As shown in FIG. 2, a outfit chamber having a designated size is formed under the accommodating space 20, and an air supplying device 30 is installed in the outfit chamber. The air supplying device 30 fundamentally removes moisture from air, and provides dry air to the inside of the accommodating space 20 to dry the clothes. Further, the air supplying device 30 heats the air to supply hot and dry air. Since hot air generally ascends upward, the air supplying device 30 is preferably installed at the lower portion of the cabinet 10, i.e., below the accommodating space 20, to supply hot and dry air. Further, the air supplying device 30 is preferably separated from the accommodating space 20 by a separate diaphragm, and the upper wall of the outfit chamber or the bottom wall of the inner cabinet 12 may serve as the diaphragm. The diaphragm prevents the clothes from being damaged by the high-temperature air supplying device 30, and prevents the clothes from being wet with condensed water generated from the air supplying device 30.

The air supplying device 30 includes a heater or a thermoelectric element generating hot air, and a dehumidifier provided separately from this heating element. Preferably, the air supplying device 30 uses a heat pump, which performs dehumidification and heating of air simultaneously.

Thus, the clothes treating apparatus uses a heat pump as the air supplying device 30. As shown in FIG. 3, the air supplying device 30 includes an evaporator 31, a compressor 32, a condenser 33, and an expansion valve (not shown), through which a refrigerant circulates. In this case, as the refrigerant in the evaporator 31 is evaporated, the refrigerant absorbs latent heat of surrounding air and thus cools the air. Due the above cooling of the air, moisture in the air is removed by condensation. Further, in case that the refrigerant is compressed by the compressor 32 and then condensed by the condenser 33, the refrigerant emits latent heat toward the surrounding air and thus heats the surrounding air. Thus, the evaporator 31 and the condenser 33 serve as heat exchangers, and air flowing into the air supplying device 30 is changed into dry and hot air through the evaporator 31 and the condenser 33.

The above air, heated by the heat pump, may have a bit lower temperature than air heated by a conventional heater, but is dehumidified without using a separate dehumidifier. Thus, the air generated by the air supplying device 30 effectively dries the clothes in the accommodating space 20 such that the clothes are refreshed into a good wearable state.

As shown in FIG. 2, an inlet 35 is provided in the accommodating space 20, and the air within the accommodating space 20 is flown into the air supplying device 30 through the inlet 35. The air flown into the air supplying device 30 is heated and dehumidified by the air supplying device 30, i.e., the evaporator 31 and the condenser 33. Further, cutlets 38 are provided in the accommodating space 20, and the dry and hot air emitted from the air supplying device 30 is supplied to the accommodating space 20 through the cutlets 38. Thus, the clothes treating apparatus has a circulation channel of the dry air generated by the air supplying device 30, and the circulation channel is extended along the inlet 35, the evaporator 31, the condenser 33, the cutlets 38, the accommodating space 20, and the inlet 35 of the air supplying device 30, as shown by the arrows in FIG. 2 and FIGS. 4 to 6.

Figure 4:
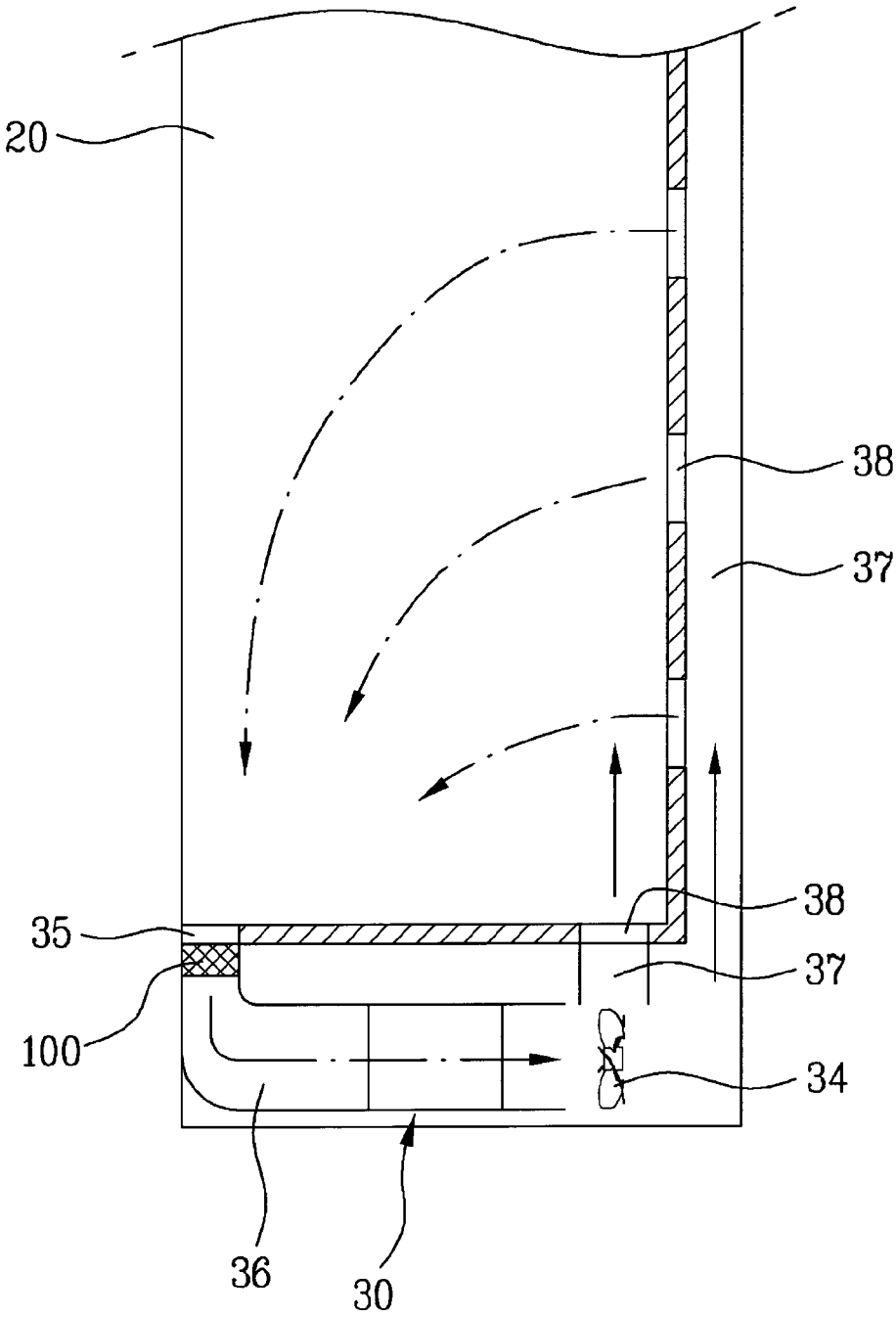
FIG. 4 is a cross-sectional view illustrating the configuration of the clothes treating apparatus in accordance with one embodiment of the present invention.

In case that the inlet 35 is formed adjacent to the outlets 38, a short flow path is formed between the inlet 35 and the outlets 38. Thus, the dry air cannot be sufficiently circulated or diffused in the accommodating space 20 the to the short flow path. Further, the supplied dry air cannot uniformly contact the clothes, and thus the clothes cannot be properly refreshed. For this reason, in order to form a long flow path, as shown in FIGS. 2 and 4, the inlet 35 is provided in the bottom of the accommodating space 20. Further, in order to obtain a longer flow path, the inlet 35 is provided in the front portion of the bottom of the accommodating space 20, i.e., in the front portion of the bottom wall of the inner cabinet 12 forming the accommodating space 20. In this case, the inlet 35 is also adjacent to the door 11 disposed in front of the accommodating space 20. Further, the cutlets 38 are provided in the rear portion of the accommodating space 20, i.e., the rear surface of the accommodating space 20. More specifically, the cutlets 38 are disposed in the rear wall of the inner cabinet 12 forming the accommodating space 20. Due to the above disposition, the accommodating space 20 has a substantially long flow path of dry air, formed between the cutlets 38 and the inlet 35. More exactly, as shown by the arrows in FIGS. 2 and 4, dry air flows from the rear portion of the accommodating space 20 to the front portion of the bottom of the accommodating space 20. Thus, the dry air entirely traverses the accommodating space 20 die to the above-disposed inlet 35 and cutlets 38. The dry air uniformly contacts clothes, and thereby properly dries the clothes. Further, the flow path of the dry air forms a kind of an air curtain at the entrance of the accommodating space 20 closed by the door 11, as shown in FIGS. 2 and 4. Thus, although the door 11 is opened during the operation of the clothes treating apparatus, the temperature in the accommodating space 20 is not excessively lowered and dust does not enter the accommodating space 20.

Further, the inlet 35 may be provided at the front edge of the bottom of the accommodating space 20. In this case, the dry air can be discharged from the cutlets 38 and completely traverse the accommodating space 20. Further, a plurality of the cutlets 38 may be provided at the rear portion of the accommodating space 20. The cutlets 38 are disposed at regular intervals from the upper region to the lower region of the rear portion of the accommodating space 20. The dry air is substantially discharged from all the regions of the rear portion of the accommodating space 20 through the cutlets 38, and flows up to the inlet 35, as shown by the arrows. Thus, the dry air entirely traverses the accommodating space 20 from the upper region to the lower region of the accommodating space 20, and the flow of the dry air in the accommodating space 20 is further uniformed so as to effectively dry and refresh the clothes.

Figure 5:
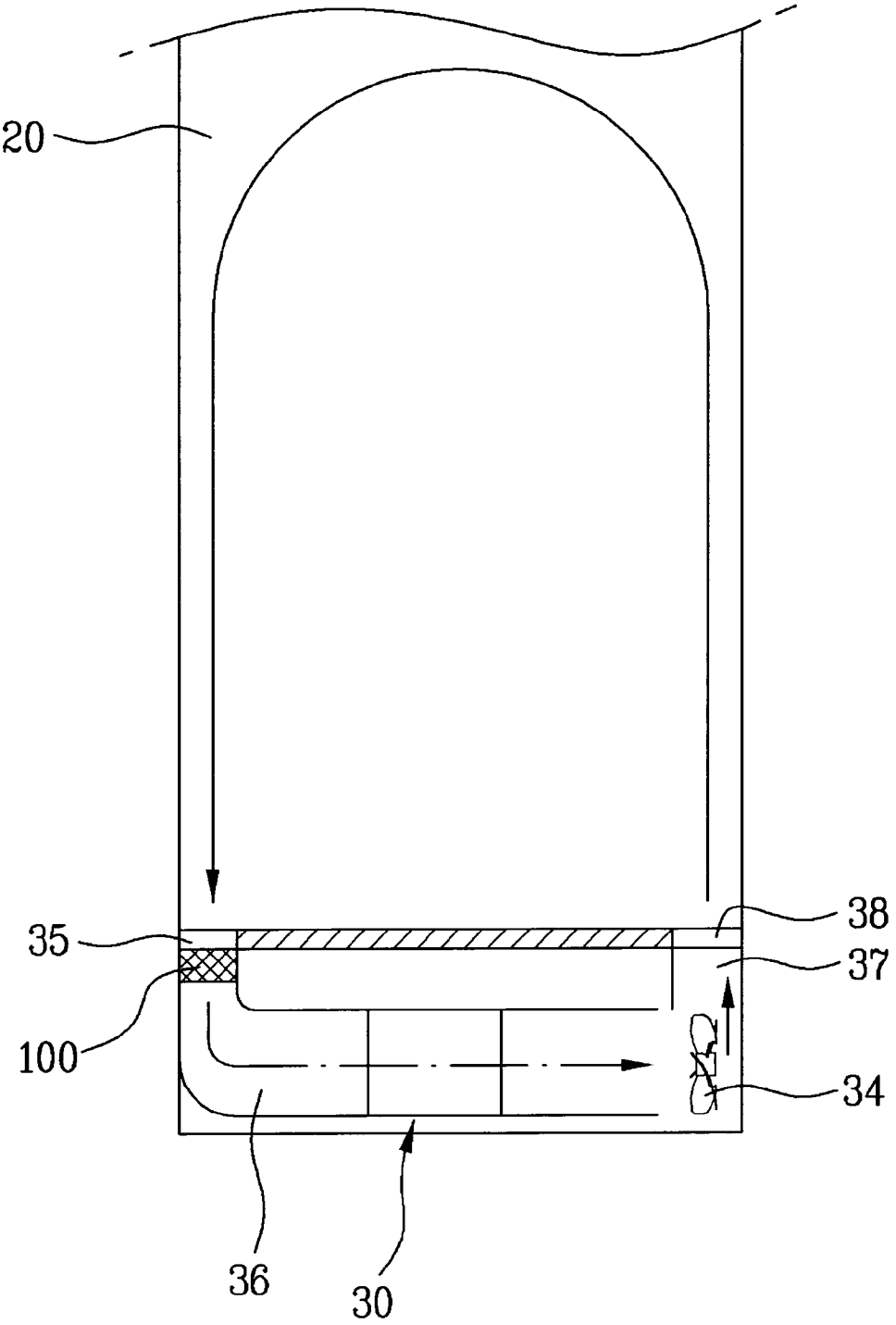
FIG. 5 is a cross-sectional view illustrating the structure of another example of the clothes treating apparatus.
Figure 6:
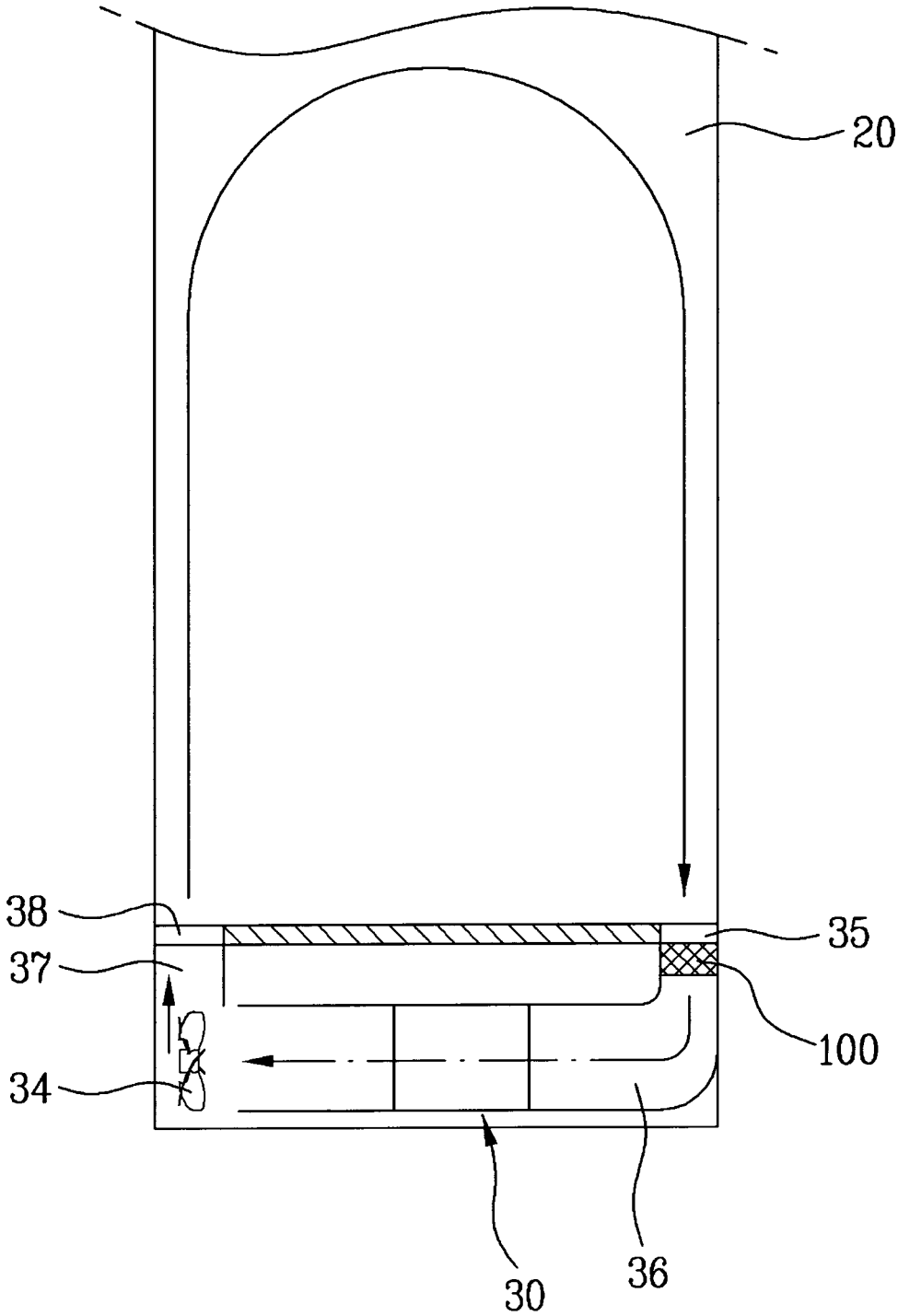
FIG. 6 is a cross-sectional view illustrating the structure of yet another example of the clothes treating apparatus.

On the other hand, as shown in FIG. 5, an inlet 35 may be disposed in the front portion of the bottom of the accommodating space 20, and an cutlet 38 may be disposed in the rear portion of the bottom of the accommodating space 20. Further, as shown in FIG. 4, the cutlet 38 disposed in the rear portion of the bottom of the accommodating space 20 may be used together with cutlets 38 disposed in the rear surface of the accommodating space 20. Further, as shown in FIG. 6, an inlet 35 may be disposed in the rear portion of the bottom of the accommodating space 20, and an cutlet 38 may be disposed in the front portion of the bottom of the accommodating space 20. In the same manner as the above-described disposition of FIG. 4, the accommodating space 20 has a substantially long flow path of dry air, formed between the cutlets 38 and the inlet 35, the to the dispositions of FIGS. 5 and 6. More specifically, as shown by the arrows in FIG. 5, the dry air ascends from the rear portion of the bottom of the accommodating space 20 to the upper region of the accommodating space 20 by a blower 34. Thereafter, the dry air descends to the front portion of the bottom of the accommodating space 20. Otherwise, as shown in FIG. 6, the dry air ascends upward from the front portion of the bottom of the accommodating space 20, and then descends to the rear portion of the bottom of the accommodating space 20. Thus, the dry air entirely traverses the accommodating space 20 the to the above-disposed inlet 35 and cutlets 38, and uniformly contacts clothes to properly dry the clothes. Further, in the same manner as the dispositions of FIGS. 2 and 4, the flow path of the dry air forms a kind of an air curtain at the entrance of the accommodating space 20 closed by the door 11, and thus exhibits the same effect as that of the dispositions of FIGS. 2 and 4.

More specifically, the air supplying device 30 includes a first duct 36 connected to the inlet 35, as shown in FIGS. 2 to 6. The evaporator 31 and the condenser 33 are disposed in the first duct 36, as shown in FIG. 3. Thus, the evaporator 31 and the condenser 33 heat and dehumidify air flowing in the first duct 36 through the inlet 35, as described above. Further, the air supplying device 30 includes a second duct 37 connected to the outlets 38. The blower 34 is installed between the second duct 37 and the first duct 31 (i.e., the evaporator 31 and the condenser 33). Thus, the air in the accommodating space 20 flows into the first duct 36 through the inlet 35, and is heated and dehumidified in the first duct 36 by the evaporator 31 and the condenser 33. Thereafter, the dry and hot air is supplied to the inside of the accommodating space 20 through the second duct 37 and the cutlets 38 by the blower 34. The first and second ducts 36 and 37 may be formed integrally. In this case, the air supplying device 30 includes a single duct, which connects the inlet 35 and the outlets 38 and is provided with the evaporator 31 and the condenser 33 installed therein.

Further, the clothes treating apparatus includes a moisture supplying device 40, which is installed in the outfit chamber in the same manner as the air supplying device 30. The moisture supplying device 40 generates moisture and selectively supplies the moisture to the inside of the accommodating space 20. In order to supply the moisture into the accommodating space 20, the moisture supplying device 40 may use mist consisting of fine drops of water, which is moisture in a liquid state, or steam, which is moisture in a gas state. Hereinafter, the moisture supplying device 40 using steam will be described. However, the moisture supplying device 40 using mist may be applied to the clothes treating apparatus for the same purpose.

The moisture supplying device 40 fundamentally includes a heater 41 to heat water, and a nozzle 43 to supply the generated steam to the inside of the accommodating space 20. The moisture supplying device 40 further includes a hose 42 to connect the heater 41 and the nozzle 43. Steam generated by the heater 41 passes through the hose 42 and the nozzle 43, and is finally supplied to the accommodating space 20 through an cutlet 44 connected to the nozzle 43. In this case, in order prevent the lowering of the temperature of the steam or the condensation of the steam while the steam flows the hose 42, the hose 42 preferably has a short length. Thus, in case that the moisture supplying device 40 is located below the accommodating space 20, it is preferable that the cutlet 44 is formed through the upper surface of the outfit chamber, i.e., the bottom of the accommodating space 20. An external tap or a container, which is installed in the outfit chamber and contains a designated amount of water, is used as a water supply source of the moisture supplying device 40. Preferably, the container is detachably installed, and thus a user can take the container out of the outfit chamber in order to fill the container with water. Further, a circulation fan 39 is provided in the outfit chamber. The circulation fan 39 supplies external air to the inside of the outfit chamber, and thus cools the air supplying device 30 and the moisture supplying device 40.

Wrinkles and static electricity of clothes can be removed by steam supplied to the inside of the accommodating space 20. Further, odors and bacteria of the clothes can be removed by steam of a high temperature. Thus, the moisture supplying device 40 refreshes the clothes into a good wearable state. A time to supply steam is properly changeable. In case that steam of a high temperature is sprayed and then dry air is supplied to the accommodating space 20, the clothes in the accommodating space 20 can be completely dried such that any moisture is not left over in the clothes. Thus, the steam is preferably sprayed into the accommodating space 20 before the dry air from the air supplying device 30 is supplied into the accommodating space 20.

The clothes accommodated in the accommodating space 20 may include dust or nap or be impregnated with odors. Further, air in the accommodating space 20 may include dust. The above foreign substances (i.e. dirt) and odors may be transferred to other clothes through air flow in the accommodating space 20, and cause some trouble in components of the clothes treating apparatus. Thus, in order to remove the foreign substances and the odors, the clothes treating apparatus includes a filter assembly 100.

The filter assembly 100 is installed in the inlet 35. In case that dust and nap in the accommodating space 20 are supplied to the air supplying device 30 through the inlet 35, the dust and the nap may cause mechanical troubles in the air supplying device 30. Thus, if the filter assembly 100 is installed in the inlet 35, the dust and the nap are removed by the filter assembly 100 before the dust and the nap enter the air supplying device 30.

When a given period of time has elapsed, the performance of the filter assembly 100 is lowered. Thus, the state of the filter assembly 100 needs to be frequently checked, and thereby the filter assembly 100 needs to be cleaned and exchanged. In case that the filter assembly 100 is installed on the rear surface or the upper portion of the accommodating space 20 being far away from the door 11, it is difficult to check the state of the filter assembly 100 or clean and exchange the filter assembly 100. However, since the inlet 35 is formed through the bottom of the accommodating space 20, the filter assembly 100 is disposed at the same position as that of the inlet 35, i.e., the bottom of the accommodating space 20. Therefore, when the door 11 is opened, a user easily accesses the filter assembly 100, and thus conveniently checks the state of the filter assembly 100 or clean and exchange the filter assembly 100. More specifically, when the inlet 35 is provided at the front portion of the bottom of the accommodating space 20, and furthermore at the edge of the front portion of the bottom of the accommodating space 20, as shown in FIGS. 4 and 5, the filter assembly 100 is disposed at the front portion of the bottom of the accommodating space 20 so as to be substantially adjacent to the door 11. Accordingly, as soon as the door 11 is opened, a user can access the filter assembly 100 and the maintenance and repair of the filter assembly 100 is conveniently carried cut. Further, as shown in FIG. 6, the filter assembly 100 may be disposed at the rear portion of the bottom of the accommodating space 20, in the same manner as the inlet 35. Even in this case, the filter assembly 100 is disposed also in the bottom of the accommodating space 20, and thus the maintenance and repair of the filter assembly 100 is conveniently carried cut.

In addition, the filter assembly 100 is detachably installed in the inlet 35. Since the filter assembly 100 needs to be periodically cleaned and exchanged, as described above, it is preferable that the filter assembly 100 is detachably installed in the inlet 35 such that the filter assembly 100 can be easily cleaned and exchanged.

Figure 7:
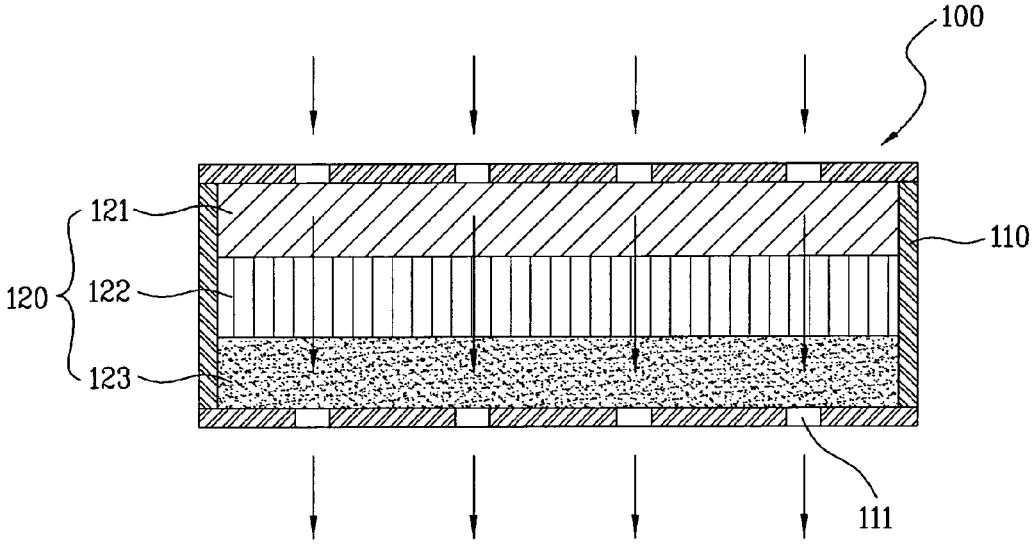
FIG. 7 is a cross-sectional view illustrating a filter assembly.

The filter assembly 100 may include a plurality of filters to remove dust and odors from air passing through the filter assembly 100 and provide an aroma/fragrance to the air. The above filter assembly 100 will be described with reference to FIG. 7, as follows.

The filter assembly 100 includes a filter unit 120, and a case 110, which accommodates the filter unit 120 and is detachably installed in the inlet 35. The case 110 includes a plurality of through holes 111, by which air pass through the filter assembly 100.

The filter assembly 100, exactly the filter unit 120 includes at least one cut of an antibiotic filter 121, a deodorant filter 122, and an aromatic filter 123. The antibiotic filter 121 removes dust and nap from the accommodated clothes and fine dust generated (bring the operation of the clothes treating apparatus, and further removes bacteria contained in air. The deodorant filter 122 contains a solid deodorant, and removes odors out of air passing through the filter assembly 100 such that the odors impregnating the accommodated clothes cannot be transferred to other clothes. The aromatic filter 123 contains an aromatic substance, such as a vegetable resin, and emits a desired aroma to the air to give the aroma to the clothes in the accommodating space 20. Therefore, the filter assembly 100 may include at least one cut of the antibiotic filter 121, the deodorant filter 122, and the aromatic filter 123, or include all of the antibiotic filter 121, the deodorant filter 122, and the aromatic filter 123.

Further, the antibiotic filter 121, the deodorant filter 122, and the aromatic filter 123 are sequentially disposed along the flow direction of the air passing through the filter assembly, as shown by the arrows in FIG. 4. That is, the antibiotic filter 121 is disposed adjacent to an inlet part of the filter assembly 100, and the aromatic filter 123 is disposed adjacent to an cutlet part of the filter assembly 100. Further, the deodorant filter 122 is disposed between the antibiotic filter 121 and the aromatic filter 123. Due to the above disposition, the antibiotic filter 121 firstly removes fine dust and nap from air passed through the inlet 35, and the deodorant filter 122 removes odors from the air passed through the antibiotic filter 121. Finally, the aromatic filter 123 changes the air passed through the deodorant filter 122 into agreeable air having a desired aroma. If the deodorant filter 122 is disposed next to the aromatic filter 123, the deodorant filter 122 may remove the aroma provided by the aromatic filter 123 as well as odors from the air. Thus, the above-described disposition is optimal for the intended functions of the filter assembly 100.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A clothes treating apparatus comprising:

a cabinet;

an accommodating space installed in the cabinet to accommodate clothes, and maintained in a stationary state; and an air supplying device generating dry air, supplying the dry air into the accommodating space such that the dry air is circulated in the accommodating space, wherein the air supplying device includes:

an inlet provided at a bottom of the accommodating space such that the air in the accommodating space flows into the air supplying device through the inlet, a first outlet provided in the bottom of the accommodating space and a second outlet provided in a rear surface of the accommodating space such that the generated dry air is discharged to the inside of the accommodating space through the outlets, and a filter assembly installed in the inlet, and filtering the air flowing from the accommodating space to the air supplying device through the inlet.

2. The clothes treating apparatus according to claim 1, wherein the inlet and the filter assembly are provided at the front portion of the bottom of the accommodating space.

3. The clothes treating apparatus according to claim 1, wherein the inlet and the filter assembly are provided at the front edge of the bottom of the accommodating space.

4. The clothes treating apparatus according to claim 1, further comprising a door installed at the cabinet to open and close an entrance formed through the front surface of the accommodating space.

5. The clothes treating apparatus according to claim 4, wherein the inlet and the filter assembly are disposed adjacent to the door.

6. The clothes treating apparatus according to claim 1, wherein the inlet and the filter assembly are provided at the rear portion of the bottom of the accommodating space.

7. The clothes treating apparatus according to claim 1, wherein the filter assembly is detachably installed in the inlet.

8. The clothes treating apparatus according to claim 1, wherein the filter assembly includes at least one out of an antibiotic filter, a deodorant filter, and an aromatic filter.

9. The clothes treating apparatus according to claim 1, wherein the filter assembly includes an antibiotic filter, a deodorant filter, and an aromatic filter.

10. The clothes treating apparatus according to claim 1, wherein the filter assembly includes filters, and a case to accommodate the filters.

11. The clothes treating apparatus according to claim 9, wherein the antibiotic filter, the deodorant filter, and the aromatic filter are sequentially disposed in the flow direction of the dry air.

12. The clothes treating apparatus according to claim 9, wherein the antibiotic filter is disposed adjacent to an inlet part of the filter assembly, the aromatic filter is disposed adjacent to an outlet part of the filter assembly, and the deodorant filter is disposed between the antibiotic filter and the aromatic filter.

13. The clothes treating apparatus according to claim 1, wherein a plurality of the second outlets are provided at the rear surface of the accommodating space along a height direction of the accommodating space.

14. The clothes treating apparatus according to claim 1, further comprising a moisture supplying device supplying moisture into the accommodating space.

15. The clothes treating apparatus according to claim 1, wherein the air supplying device further includes:

a duct connecting the inlet and the outlets;

an evaporator provided in the duct, and absorbing heat from surrounding air to cool and dehumidify the air;

a condenser provided in the duct, and emitting heat to surrounding air to heat the air; and a blower provided in the duct, and disposed between the condenser/evaporator and the outlets.

* * * * *